US005547821A

United States Patent [19]

Melpolder et al.

[11] Patent Number: 5,547,821

[45] Date of Patent: Aug. 20, 1996

[54] THERMALLY PROCESSABLE IMAGING ELEMENT COMPRISING A SURFACE LAYER THAT IS ELECTROCONDUCTIVE

[75] Inventors: Sharon M. Melpolder, Hilton; Charles C. Anderson, Penfield; Peter J. Cowdery-Corvan, Webster; John F. DeCory, Rochester, all of N.Y.

[73] Assignee: Eastman Kodak Company, Rochester, N.Y.

[21] Appl. No.: 442,743

[22] Filed: May 17, 1995

Related U.S. Application Data

[63] Continuation of Ser. No. 228,836, Apr. 18, 1994, abandoned.

[51] Int. Cl.[6] ..... G03C 1/85; G03C 1/77; G03C 1/00; G03C 1/76

[52] U.S. Cl. ..... 430/527; 430/203; 430/524; 430/526; 430/530; 430/617; 430/618; 430/531; 430/533

[58] Field of Search ..... 430/524, 526, 430/527, 530, 617, 618, 619, 620, 203, 964

[56] References Cited

U.S. PATENT DOCUMENTS

| | | | |
|---|---|---|---|
| 4,262,072 | 4/1981 | Wendling et al. | 430/14 |
| 4,741,992 | 5/1988 | Przezdziecki | 430/523 |
| 4,816,363 | 3/1989 | Nairo et al. | 430/203 |
| 4,828,971 | 5/1989 | Przezdziecki | 430/531 |
| 4,886,739 | 12/1989 | Przezdziecki | 430/617 |
| 4,942,115 | 7/1990 | Przezdziecki | 430/523 |
| 5,196,297 | 3/1993 | Dombrowski et al. | 430/338 |
| 5,221,598 | 6/1993 | Anderson et al. | 430/527 |
| 5,308,687 | 5/1994 | Melpolder et al. | 430/530 |
| 5,310,640 | 5/1994 | Markin et al. | 430/617 |
| 5,360,706 | 11/1994 | Anderson et al. | 430/530 |

*Primary Examiner*—Charles L. Bowers, Jr.
*Assistant Examiner*—J. Pastevczyk
*Attorney, Agent, or Firm*—Alfred P. Lorenzo

[57] ABSTRACT

Thermally processable imaging elements in which the image is formed by imagewise heating or by imagewise exposure to light followed by uniform heating are provided with an electroconductive overcoat layer or an electroconductive backing layer or both an electroconductive overcoat layer and an electroconductive backing layer. Such electroconductive layers are comprised of electrically-conductive metal-containing particles dispersed in a polymeric binder in an amount sufficient to provide a surface resistivity of less than $5\times10^{11}$ ohms/square.

18 Claims, No Drawings

THERMALLY PROCESSABLE IMAGING ELEMENT COMPRISING A SURFACE LAYER THAT IS ELECTROCONDUCTIVE

CROSS-REFERENCE TO RELATED APPLICATIONS

This is a continuation of application Ser. No. U.S. Pat. No. 228,836, filed 18 Apr. 1994 and now abandoned.

Thermally processable imaging elements comprised of:

(1) a support;

(2) a thermographic or photothermographic imaging layer on one side of the support;

(3) a backing layer which is an outermost layer and is located on the side of the support opposite to the imaging layer, the backing layer comprising a binder and a matting agent dispersed therein; and (4) an electroconductive layer which is an inner layer and is located on either side of the support, the electroconductive layer having an internal resistivity of less than $5\times10^{10}$ ohms/square; are disclosed and claimed in copending commonly assigned U.S. patent application Ser. No. 071,806, filed Jun. 2, 1993, "Thermally Processable Imaging Element Comprising An Electroconductive Layer And A Backing Layer" by L. Jeffrey Markin, Diane E. Kestner, Wojciech M. Przezdziecki and Peter J. Cowdery-Corvan and issued May 10, 1994, as U.S. Pat. No. 5,310,640.

FIELD OF THE INVENTION

This invention relates in general to imaging elements and in particular to thermally processable imaging elements. More specifically, this invention relates to imaging elements comprising a thermographic or photothermographic layer, and a surface layer that is electroconductive.

BACKGROUND OF THE INVENTION

Thermally processable imaging elements, including films and papers, for producing images by thermal processing are well known. These elements include photothermographic elements in which an image is formed by imagewise exposure of the element to light followed by development by uniformly heating the element. These elements also include thermographic elements in which an image is formed by imagewise heating the element. Such elements are described in, for example, Research Disclosure, June 1978, Item No. 17029 and U.S. Pat. Nos. 3,080,254, 3,457,075 and 3,933,508.

The aforesaid thermally processable imaging elements are often provided with an overcoat layer and/or a backing layer, with the overcoat layer being the outermost layer on the side of the support on which the imaging layer is coated and the backing layer being the outermost layer on the opposite side of the support. Other layers which are advantageously incorporated in thermally processable imaging elements include subbing layers and barrier layers.

To be fully acceptable, a protective overcoat layer for such imaging elements should: (a) provide resistance to deformation of the layers of the element during thermal processing, (b) prevent or reduce loss of volatile components in the element during thermal processing, (c) reduce or prevent transfer of essential imaging components from one or more of the layers of the element into the overcoat layer during manufacture of the element or during storage of the element prior to imaging and thermal processing, (d) enable satisfactory adhesion of the overcoat to a contiguous layer of the element, and (e) be free from cracking and undesired marking, such as abrasion marking, during manufacture, storage, and processing of the element.

A backing layer also serves several important functions which improve the overall performance of thermally processable imaging elements. For example, a backing layer serves to improve conveyance, reduce static electricity and eliminate formation of Newton Rings.

A particularly preferred overcoat for thermally processable imaging elements is an overcoat comprising poly(silicic acid) as described in U.S. Pat. No. 4,741,992, issued May 3, 1988. Advantageously, water-soluble hydroxyl-containing monomers or polymers are incorporated in the overcoat layer together with the poly(silicic acid). The combination of poly(silicic acid) and a water-soluble hydroxyl-containing monomer or polymer that is compatible with the poly(silicic acid) is also useful in a backing layer on the side of the support opposite to the imaging layer as described in U.S. Pat. No. 4,828,971, issued May 9, 1989.

One of the most difficult problems involved in the manufacture of thermally processable imaging elements is that the protective overcoat layer typically does not exhibit adequate adhesion to the imaging layer. The problem of achieving adequate adhesion is particularly aggravated by the fact that the imaging layer is typically hydrophobic while the overcoat layer is typically hydrophilic. One solution to this problem is that described in U.S. Pat. No. 4,886,739, issued Dec. 12, 1989, in which a polyalkoxysilane is added to the thermographic or photothermographic imaging composition and is hydrolyzed in situ to form an $R_xSi(OH)_{4-x}$ moiety which has the ability to crosslink with binders present in the imaging layer and the overcoat layer. Another solution to the problem is that described in U.S. Pat. No. 4,942,115, issued Jul. 17, 1990, in which an adhesion-promoting layer, in particular a layer composed of an adhesion-promoting terpolymer, is interposed between the imaging layer and the overcoat layer.

U.S. Pat. No. 4,828,971 explains the requirements for backing layers in thermally processable imaging elements. It points out that an optimum backing layer must:

(a) provide adequate conveyance characteristics during manufacturing steps, (b) provide resistance to deformation of the element during thermal processing, (c) enable satisfactory adhesion of the backing layer to the support of the element without undesired removal during thermal processing, (d) be free from cracking and undesired marking, such as abrasion marking during manufacture, storage and processing of the element, (e) reduce static electricity effects during manufacture and (f) not provide undesired sensitometric effects in the element during manufacture, storage or processing.

To meet all of these requirements with a single layer has proven to be extraordinarily difficult. While the backing layer of the '971 patent has excellent performance characteristics, its electrical conductivity is highly dependent on humidity. Under the very low humidity conditions involved in the high temperature processing chambers employed with thermally processable imaging elements, its conductivity is much too low to provide good protection against the buildup of static charge. Static charge can lead to static marking in the processed film, poor transport through processing equipment, and sticking together of processed sheets of film ("static cling").

In copending commonly assigned U.S. patent application Ser. No. 071,806, which is referred to hereinabove, separate backing and electroconductive layers are provided to meet the very stringent requirements of the thermal processing art. In particular, application Ser. No. 071,806 describes the use of an inner electroconductive layer in which the conductive properties are independent of humidity and the use of a separate backing layer which provides the other necessary features which enable effective use of the element. Use of separate backing and electroconductive layers enables each of them to be specifically tailored to meet the specific requirements for which the layer is intended. However, the need to provide separate electroconductive and backing layers increases both manufacturing complexity and cost. In addition, while the use of separate electroconductive and backing layers provides good protection against static-related problems, it is more effective to utilize an electroconductive material in a surface layer rather than in an interior layer that is overcoated with an insulating material (that is, the conductive layer is a "buried" layer). In the former case it is possible for surface charges to be dissipated by conduction of charge across the conductive surface to a ground plane. A buried conductive layer may only transform free charge to polar charge (the term "polar charge" refers to the presence of equal and opposite charge on the two surfaces of a dielectric sheet) by imaging (with an equal and opposite charge) the triboelectric charge created on the contacted surface. This charge imaging process can reduce the distance at which an electric field can be measured (for example, with a field meter) to a distance on the order of the thickness of the imaging element. Thus for example, a dirt particle at a long distance from the imaging element is unlikely to be attracted to the film as a result of electrostatic attraction. However, foreign objects or other sheets of film that are in direct contact with the imaging element containing the image charge are very likely to be subject to the electric field. Thus charge dissipation via a conductive outermost layer is the most effective way to provide protection against static-related problems. It is toward the objective of providing a surface conductive layer that retains all other desirable features required for thermographic or photothermographic imaging elements that the present invention is directed.

SUMMARY OF THE INVENTION

In accordance with this invention, a thermally processable imaging element is comprised of:

(1) a support;

(2) a thermographic or photothermographic imaging layer on one side of the support; and (3) at least one electroconductive outermost layer comprised of electrically-conductive metal-containing particles dispersed in a polymeric binder in an amount sufficient to provide a surface resistivity of less than $5\times10^{11}$ ohms/square.

In terms of layer arrangement, a number of different formats are suitable for the thermally processable imaging element of this invention. The essential components of the imaging element are the support, which may contain one or more subbing layers on one or both sides, the imaging layer, and the electroconductive layer. The electroconductive layer is an outermost layer, that is, a surface layer and it can serve as a protective overcoat layer which provides protection against static or as a backing layer which provides protection against static. Suitable layer arrangements include:

(A) an element comprising a support having a non-electroconductive backing layer on one side thereof and having, in order, on the opposite side an imaging layer and an electroconductive overcoat layer;

(B) an element comprising a support having an electroconductive backing layer on one side thereof and having, in order, on the opposite side an imaging layer and a non-electroconductive overcoat layer;

(C) an element comprising a support having an electroconductive backing layer on one side thereof and having, in order, on the opposite side, an imaging layer and an electroconductive overcoat layer.

The metal-containing particles utilized in this invention are electronically conductive and thus the electrical conductivity of the layer in which they are incorporated is essentially independent of humidity.

Since the electroconductive surface layer utilized herein performs multiple functions, for example, the functions of an overcoat layer and of an antistatic layer or the functions of a backing layer and of an antistatic layer, it enables a reduction in the total number of layers required as compared to the elements of U.S. patent application Ser. No. 071,806. It was unexpected that a single layer would be highly effective in performing multiple functions in view of the very stringent performance requirements to which thermally processable imaging elements are subject.

DESCRIPTION OF THE PREFERRED EMBODIMENTS

The thermally processable imaging element of this invention can be of the type in which an image is formed by imagewise heating of the element or of the type in which an image is formed by imagewise exposure to light followed by uniform heating of the element. The latter type of element is commonly referred to as a photothermographic element.

Typical photothermographic imaging elements within the scope of this invention comprise at least one imaging layer containing in reactive association in a binder, preferably a binder comprising hydroxyl groups, (a) photographic silver halide prepared in situ and/or ex situ, (b) an image-forming combination comprising (i) an organic silver salt oxidizing agent, preferably a silver salt of a long chain fatty acid, such as silver behenate, with (ii) a reducing agent for the organic silver salt oxidizing agent, preferably a phenolic reducing agent, and (c) an optional toning agent. References describing such imaging elements include, for example, U.S. Pat. Nos. 3,457,075; 4,459,350; 4,264,725 and 4,741,992 and *Research Disclosure*, June 1978, Item No. 17029.

The photothermographic element comprises a photosensitive component that consists essentially of photographic silver halide. In the photothermographic material it is believed that the latent image silver from the silver halide acts as a catalyst for the described image-forming combination upon processing. A preferred concentration of photographic silver halide is within the range of 0.01 to 10 moles of photographic silver halide per mole of silver behenate in the photothermographic material. Other photosensitive silver salts are useful in combination with the photographic silver halide if desired. Preferred photographic silver halides are silver chloride, silver bromide, silver bromochloride, silver bromoiodide, silver chlorobromoiodide, and mixtures of these silver halides. Very fine grain photographic silver halide is especially useful. The photographic silver halide can be prepared by any of the known procedures in the photographic art. Such procedures for forming photographic silver halides and forms of photographic silver halides are described in, for example,

*Research Disclosure*, December 1978, Item No. 17029 and *Research Disclosure*, June 1978, Item No. 17643. Tabular grain photosensitive silver halide is also useful, as described in, for example, U.S. Pat. No. 4,435,499. The photographic silver halide can be unwashed or washed, chemically sensitized, protected against the formation of fog, and stabilized against the loss of sensitivity during keeping as described in the above Research Disclosure publications. The silver halides can be prepared in situ as described in, for example, U.S. Pat. No. 4,457,075, or prepared ex situ by methods known in the photographic art.

The photothermographic element typically comprises an oxidation-reduction image forming combination that contains an organic silver salt oxidizing agent, preferably a silver salt of a long chain fatty acid. Such organic silver salts are resistant to darkening upon illumination. Preferred organic silver salt oxidizing agents are silver salts of long chain fatty acids containing 10 to 30 carbon atoms. Examples of useful organic silver salt oxidizing agents are silver behenate, silver stearate, silver oleate, silver laurate, silver hydroxystearate, silver caprate, silver myristate, and silver palmitate. Combinations of organic silver salt oxidizing agents are also useful. Examples of useful organic silver salt oxidizing agents that are not organic silver salts of fatty acids are silver benzoate and silver benzotriazole.

The optimum concentration of organic silver salt oxidizing agent in the photothermographic element will vary depending upon the desired image, particular organic silver salt oxidizing agent, particular reducing agent and particular photothermographic element. A preferred concentration of organic silver salt oxidizing agent is within the range of 0.1 to 100 moles of organic silver salt oxidizing agent per mole of silver halide in the element. When combinations of organic silver salt oxidizing agents are present, the total concentration of organic silver salt oxidizing agents is preferably within the described concentration range.

A variety of reducing agents are useful in the photothermographic element. Examples of useful reducing agents in the image-forming combination include substituted phenols and naphthols, such as bis-beta-naphthols; polyhydroxybenzenes, such as hydroquinones, pyrogallols and catechols; aminophenols, such as 2,4-diaminophenols and methylaminophenols; ascorbic acid reducing agents, such as ascorbic acid, ascorbic acid ketals and other ascorbic acid derivatives; hydroxylamine reducing agents; 3-pyrazolidone reducing agents, such as 1-phenyl-3-pyrazolidone and 4-methyl-4-hydroxymethyl-1-phenyl-3-pyrazolidone; and sulfonamidophenols and other organic reducing agents known to be useful in photothermographic elements, such as described in U.S. Pat. No. 3,933,508, U.S. Pat. No. 3,801,321 and *Research Disclosure*, June 1978, Item No. 17029. Combinations of organic reducing agents are also useful in the photothermographic element.

Preferred organic reducing agents in the photothermographic element are sulfonamidophenol reducing agents, such as described in U.S. Pat. No. 3,801,321. Examples of useful sulfonamidophenol reducing agents are 2,6-dichloro-4-benzenesulfonamidophenol; benzenesulfonamidophenol; and 2,6-dibromo-4-benzenesulfonamidophenol, and combinations thereof.

An optimum concentration of organic reducing agent in the photothermographic element varies depending upon such factors as the particular photothermographic element, desired image, processing conditions, the particular organic silver salt and the particular oxidizing agent.

The photothermographic element preferably comprises a toning agent, also known as an activator-toner or toner-accelerator. Combinations of toning agents are also useful in the photothermographic element. Examples of useful toning agents and toning agent combinations are described in, for example, Research Disclosure, June 1978, Item No. 17029 and U.S. Pat. No. 4,123,282. Examples of useful toning agents include, for example, phthalimide, N-hydroxyphthalimide, N-potassium-phthalimide, succinimide, N-hydroxy-1,8-naphthalimide, phthalazine, 1-(2H)-phthalazinone and 2-acetylphthalazinone.

Post-processing image stabilizers and latent image keeping stabilizers are useful in the photothermographic element. Any of the stabilizers known in the photothermographic art are useful for the described photothermographic element. Illustrative examples of useful stabilizers include photolyrically active stabilizers and stabilizer precursors as described in, for example, U.S. Pat. No. 4,459,350. Other examples of useful stabilizers include azole thioethers and blocked azolinethione stabilizer precursors and carbamoyl stabilizer precursors, such as described in U.S. Pat. No. 3,877,940.

The thermally processable elements as described preferably contain various colloids and polymers alone or in combination as vehicles and binders and in various layers. Useful materials are hydrophilic or hydrophobic. They are transparent or translucent and include both naturally occurring substances, such as gelatin, gelatin derivatives, cellulose derivatives, polysaccharides, such as dextran, gum arabic and the like; and synthetic polymeric substances, such as water-soluble polyvinyl compounds like poly(vinylpyrrolidone) and acrylamide polymers. Other synthetic polymeric compounds that are useful include dispersed vinyl compounds such as in latex form and particularly those that increase dimensional stability of photographic elements. Effective polymers include water insoluble polymers of acrylates, such as alkylacrylates and methacrylates, acrylic acid, sulfoacrylates, and those that have cross-linking sites. Preferred high molecular weight materials and resins include poly(vinyl butyral), cellulose acetate butyrate, poly(methylmethacrylate), poly(vinylpyrrolidone), ethyl cellulose, polystyrene, poly(vinylchloride), chlorinated rubbers, polyisobutylene, butadiene-styrene copolymers, copolymers of vinyl chloride and vinyl acetate, copolymers of vinylidene chloride and vinyl acetate, poly(vinyl alcohol) and polycarbonates.

Photothermographic elements and thermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in *Research Disclosure*, December 1978, Item No. 17643 and *Research Disclosure*, June 1978, Item No. 17029.

The thermally processable element can comprise a variety of supports. Examples of useful supports are poly(vinylacetal) film, polystyrene film, poly(ethyleneterephthalate) film, poly(ethylene naphthalate) film, polycarbonate film, and related films and resinous materials, as well as paper, glass, metal, and other supports that withstand the thermal processing temperatures.

The layers of the thermally processable element are coated on a support by coating procedures known in the photographic art, including dip coating, air knife coating, curtain coating or extrusion coating using hoppers. If desired, two or more layers are coated simultaneously.

Spectral sensitizing dyes are useful in the photothermographic element to confer added sensitivity to the element.

Useful sensitizing dyes are described in, for example, *Research Disclosure*, June 1978, Item No. 17029 and *Research Disclosure*, December 1978, Item No. 17643.

A photothermographic element as described preferably comprises a thermal stabilizer to help stabilize the photothermographic element prior to exposure and processing. Such a thermal stabilizer provides improved stability of the photothermographic element during storage. Preferred thermal stabilizers are 2-bromo-2-arylsulfonylacetamides, such as 2-bromo- 2-p-tolysulfonylacetamide; 2-(tribromomethyl sulfonyl)benzothiazole; and 6-substituted-2,4-bis(tribromomethyl)-s-triazines, such as 6-methyl or 6-phenyl- 2,4-bis(tribromomethyl)-s-triazine.

The thermally processable elements are exposed by means of various forms of energy. In the case of the photothermographic element such forms of energy include those to which the photographic silver halides are sensitive and include ultraviolet, visible and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide. Imagewise exposure is preferably for a time and intensity sufficient to produce a developable latent image in the photothermographic element.

After imagewise exposure of the photothermographic element, the resulting latent image is developed merely by overall heating the element to thermal processing temperature. This overall heating merely involves heating the photothermographic element to a temperature within the range of about 90° C. to 180° C. until a developed image is formed, such as within about 0.5 to about 60 seconds. By increasing or decreasing the thermal processing temperature a shorter or longer time of processing is useful. A preferred thermal processing temperature is within the range of about 100° C. to about 140° C.

In the case of a thermographic element, the thermal energy source and means for imaging can be any imagewise thermal exposure source and means that are known in the thermographic imaging art. The thermographic imaging means can be, for example, an infrared heating means, laser, microwave heating means or the like.

Heating means known in the photothermographic and thermographic imaging arts are useful for providing the desired processing temperature for the exposed photothermographic element. The heating means is, for example, a simple hot plate, iron, roller, heated drum, microwave heating means, heated air or the like.

Thermal processing is preferably carried out under ambient conditions of pressure and humidity. Conditions outside of normal atmospheric pressure and humidity are useful.

The components of the thermally processable element can be in any location in the element that provides the desired image. If desired, one or more of the components can be in one or more layers of the element. For example, in some cases, it is desirable to include certain percentages of the reducing agent, toner, stabilizer and/or other addenda in the overcoat layer over the photothermographic imaging layer of the element. This, in some cases, reduces migration of certain addenda in the layers of the element.

It is necessary that the components of the imaging combination be "in association" with each other in order to produce the desired image. The term "in association" herein means that in the photothermographic element the photographic silver halide and the image forming combination are in a location with respect to each other that enables the desired processing and forms a useful image.

As hereinabove described, the thermally processable imaging element of this invention includes at least one electroconductive surface layer; the term "surface layer" referring to an outermost layer. Thus, the element can comprise an electroconductive overcoat, an electroconductive backing layer, or both an electroconductive overcoat and an electroconductive backing layer.

The backing layer utilized in this invention is an outermost layer and is located on the side of the support opposite to the imaging layer. It is comprised of a binder, a matting agent, and, except in the case where the overcoat layer is the only electroconductive layer, a conductive agent. The matting agent and the conductive agent are dispersed in the binder in an amount sufficient to provide the desired surface roughness and conductivity, respectively.

A wide variety of materials can be used to prepare a backing layer that is compatible with the requirements of thermally processable imaging elements. The backing layer should be transparent and colorless and should not adversely affect sensitometric characteristics of the photothermographic element such as minimum density, maximum density and photographic speed. Preferred backing layers are those comprised of poly(silicic acid) and a water-soluble hydroxyl containing monomer or polymer that is compatible with poly(silicic acid) as described in U.S. Pat. No. 4,828,971. A combination of poly(silicic acid) and poly(vinyl alcohol) is particularly useful. Other useful backing layers include those formed from polymethylmethacrylate, cellulose acetate, crosslinked polyvinyl alcohol, terpolymers of acrylonitrile, vinylidene chloride, and 2-(methacryloyloxy-)ethyltrimethylammonium methosulfate, crosslinked gelatin, polyesters and polyurethanes.

In the thermally processable imaging elements of this invention, either organic or inorganic matting agents can be used. Examples of organic matting agents are particles, often in the form of beads, of polymers such as polymeric esters of acrylic and methacrylic acid, e.g., poly(methylmethacrylate), styrene polymers and copolymers, and the like. Examples of inorganic matting agents are particles of glass, silicon dioxide, titanium dioxide, magnesium oxide, aluminum oxide, barium sulfate, calcium carbonate, and the like.

Matting agents and the way they are used are further described in U.S. Pat. Nos. 3,411,907 and 3,754,924.

The backing layer preferably has a glass transition temperature (Tg) of greater than 50° C., more preferably greater than 100° C., and a surface roughness such that the Roughness Average (Ra) value is greater than 0.8, more preferably greater than 1.2, and most preferably greater than 1.5.

As described in U.S. Pat. No. 4,828,971, the Roughness Average (Ra) is the arithmetic average of all departures of the roughness profile from the mean line.

The concentration of matting agent required to give the desired roughness depends on the mean diameter of the particles and the amount of binder. Preferred particles are those with a mean diameter of from about 0.5 to about 15 micrometers, preferably from 2 to 8 micrometers. The matte particles can be usefully employed at a concentration of about 0.5 to about 100 milligrams per square meter.

The electroconductive layer utilized in this invention is an outermost layer. It can be disposed on either side or on both sides of the support. That is, either the backing layer or the overcoat layer or both of these layers can be an electroconductive layer. As indicated hereinabove, it has a surface resistivity of less than $5\times10^{11}$ ohms/square. Preferably, the surface resistivity of the electroconductive layer is less than $1\times10^{11}$ ohms/square.

The electroconductive layer utilized in this invention is comprised of electrically-conductive metal-containing particles dispersed in a polymeric binder in an amount sufficient to provide the desired surface resistivity. Examples of suitable electrically-conductive metal-containing particles for the purposes of this invention include:

(1) Donor-doped metal oxides, metal oxides containing oxygen deficiencies, and conductive nitrides, carbides, and borides. Specific examples of particularly useful particles include conductive $TiO_2$, $SnO_2$, $V_2O_5$, $Al_2O_3$, $ZrO_2$, $In_2O_3$, ZnO, $TiB_2$, $ZrB_2$, $NbB_2$, $TaB_2$, $CrB_2$, MoB, WB, $LaB_6$, ZrN, TiN, TiC, WC, HfC HfN, ZrC. Examples of the many patents describing these electrically-conductive particles include U.S. Pat. Nos. 4,275,103, 4,394,441, 4,416,963, 4,418,141, 4,431,764, 4,495,276, 4,571,361, 4,999,276, and 5,122,445.

(2) Semiconductive metal salts such as cuprous iodide as described in U.S. Pat. Nos. 3,245,833, 3,428,451 and 5,075,171;

(3) A colloidal gel of vanadium pentoxide as described in U.S. Pat. Nos. 4,203,769, 5,006,451, 5,221,598, and 5,284,714.

(4) Fibrous conductive powders comprising, for example, antimony-doped tin oxide coated onto non-conductive potassium titanate whiskers as described in U.S. Pat. Nos. 4,845,369 and 5,116,666.

A colloidal gel of vanadium pentoxide is especially useful for forming the electroconductive layer. Preferably, the vanadium pentoxide is doped with silver. The colloidal vanadium pentoxide gel typically consists of entangled, high aspect ratio, flat ribbons about 50–100 angstroms wide, about 10 angstroms thick, and about 1000–10000 angstroms long. This unique morphology results in higher electrical conductivity than is typically observed for layers of similar thickness containing crystalline vanadium pentoxide particles. Low surface resistivities can be obtained with very low vanadium pentoxide coverages. This results in low optical absorption and scattering losses. Also, the coating containing the colloidal vanadium pentoxide gel is highly adherent to underlying support materials. Typically, the dry coating weight of vanadium pentoxide employed in the electroconductive layer is about 0.5 to 50 mg/m$^2$, preferably about 1 to 30 mg/m$^2$.

Conductive antimony-doped tin oxide particles are another preferred conductive agent which can be employed in the electroconductive layer. Typically, the mean diameter of these particles is about 200 nanometers or less, preferably the mean diameter is less than 100 nanometers. The dry coating weight of conductive tin oxide particles employed in the electroconductive layer is less than about 1 gram/m$^2$ to insure acceptable optical densities for the coating.

Thicknesses for the various layers utilized in the thermally processable imaging elements of this invention can be widely varied as desired. Representative dry thicknesses are from about 0.1 to 2μm for the backing layer, from about 1 to about 15μm for the imaging layer, and from about 0.5 to about 10μm for the overcoat layer.

The invention is further illustrated by the following examples of its practice. For purposes of comparison, two control elements, as described below, were prepared and evaluated.

Control 1

Control 1 comprised a 0.1 millimeter thick polyethylene terephthalate film, subbed on both sides with a vinylidene chloride-containing terpolymer latex well known in the art, as a support. The subbed polyethylene terephthalate film was coated on one side with a backing layer having a dry thickness of 0.1μm and on its opposite side, in order, with an imaging layer having a dry thickness of 9μm and an overcoat layer having a dry thickness of 2μm. The composition of the backing layer, imaging layer and overcoat layer was the same as that described for element B in Example 1 of U.S. Pat. No. 4,828,971.

Control 2

A thermally processable imaging element similar to that described in Example 2 of patent application Ser. No. 071,806 was prepared. This element comprised a 0.1 millimeter thick polyethylene terephthalate film support having an imaging layer and an overcoat layer on one side of the support and separate electroconductive and backing layers on the opposite side of the support. The electroconductive layer had a thickness of 0.02μm and was composed of a colloidal gel of silver-doped vanadium pentoxide dispersed in a polymeric binder. The electroconductive layer was overcoated with a 0.5μm thick (approximately 0.5 gram/m$^2$ dry coating weight) backing layer composed of polymethylmethacrylate. This backing layer contained polymeric matte particles with a particle size of 2 to 4μm applied at a dry coating weight of 25 mg/m$^2$. The overcoat layer was the same as that described for element B in Example 1 of U.S. Pat. No. 4,828,971.

Both the control elements and the elements of the following examples were tested with respect to surface resistivity at 20% RH, propensity to dusting, blue $D_{min}$ and abrasion resistance. Surface resistivity was measured using a 2-point probe after conditioning the samples at 20% RH for 4 hours. To evaluate the propensity for dusting the element is subjected to a load and the backing layer is drawn across a rough black interleaving paper. The amount of matte particles that transfer is rated relative to a standard, with a rating of 1 being the best and a rating of 4 being the worst. To determine whether the sensitometric characteristics of the film are acceptable, the Status A blue $D_{min}$ level was measured after thermal processing. Taber abrasion of the electroconductive backing layer was determined in accordance with the procedures set forth in ASTM D1044. Resistance to belt marks, which are embossed artifacts in the overcoat caused by processing, and other physical abrasions was determined by inspecting the imaging elements after conventional thermal processing. The samples were rated as excellent, good, or poor with respect to their appearance after processing. The antistatic effectiveness of the control elements and of the Example 2 element was evaluated by roller electrification studies for 90 meter sample rolls running over stainless steel segmented rollers. The test procedure has been described by K. L. Clum and R. J. Pazda, "The Segmented Roller: A Device for Measuring Charge Density on a Moving Conductive Web", *J. of Electrostics*, Vol. 24, No. 1989, pp. 21–32. The value for the fraction of charge retained after each contact with a roller (denoted by the constant s) and the amount of new charge which is transferred to the web at each contact (denoted by the constant $q_o$) were determined for each sample conveyed at 80 meters/min at a relative humidity of 15% RH. Both s and $q_o$ affect the maximum amount of charge which will accumulate on a web as a result of repeated contacts to a roller. Accumulating charge on the web will approach a limiting value, $q_e$, which is related to $q_o$ and s by $q_e=q_o/(1-s)$. Equilibrium charge varies in proportion to $q_o$ and also depends very strongly on the value of s. The value of s ranges from 0 to 1 and the smaller the value the more effective the antistatic layer.

EXAMPLES 1–19

Thermally processable imaging elements were prepared that were the same as Control 1 except that they contained either an electroconductive overcoat or an electroconductive backing layer as described herein. A description of these imaging elements is given in Table 1. The antimony-doped tin oxide particles used in the examples contained about 6 weight % Sb and had a mean particle diameter of 50 nm. The following binder polymers were used in the examples: Witcobond 232, (an aqueous polyurethane dispersion available from Witco Corporation), a water soluble acrylamide-co-methylmethacrylate-co-hydroxyethyl methacrylate terpolymer, Eastman Chemical Co. AQ29 polyester ionomer dispersion, vinylidene chloride-co-methyl acrylate-co-itaconic acid terpolymer latex, poly(silicic acid) and poly(vinyl alcohol) combination (PSA/PVA), and gelatin.

The results obtained for the control elements and for the examples are summarized in Table 2. The results for the roller electrification studies are summarized in Table 3.

TABLE 1

| Element | Conductive Layer | Conductive Agent | Binder Material | Weight % Conductive Agent in Layer | Conductive Layer Dry Coating Wt mg/m$^2$ |
|---|---|---|---|---|---|
| Example 1 | Backing | Sb-doped $SnO_2$ | Witcobond 232 | 60 | 250 |
| Example 2 | Backing | Sb-doped $SnO_2$ | Witcobond 232 | 75 | 250 |
| Example 3 | Backing | Sb-doped $SnO_2$ | Witcobond 232 | 60 | 500 |
| Example 4 | Backing | Sb-doped $SnO_2$ | Witcobond 232 | 75 | 500 |
| Example 5 | Backing | Sb-doped $SnO_2$ | Witcobond 232 | 60 | 750 |
| Example 6 | Backing | Sb-doped $SnO_2$ | Witcobond 232 | 75 | 750 |
| Example 7 | Backing | Sb-doped $SnO_2$ | acrylamide polymer | 40 | 500 |
| Example 8 | Backing | Sb-doped $SnO_2$ | acrylamide polymer | 60 | 500 |
| Example 9 | Backing | Sb-doped $SnO_2$ | acrylamide polymer | 75 | 500 |
| Example 10 | Backing | Sb-doped $SnO_2$ | Eastman AQ29 | 40 | 500 |
| Example 11 | Backing | Sb-doped $SnO_2$ | Eastman AQ29 | 60 | 500 |
| Example 12 | Backing | Sb-doped $SnO_2$ | Eastman AQ29 | 75 | 500 |
| Example 13 | Backing | Sb-doped $SnO_2$ | vinylidene chloride latex | 40 | 500 |
| Example 14 | Backing | Sb-doped $SnO_2$ | vinylidene chloride latex | 60 | 500 |
| Example 15 | Backing | Sb-doped $SnO_2$ | vinylidene chloride latex | 75 | 500 |
| Example 16 | Backing | Ag-doped $V_2O_5$ | vinylidene chloride latex | 1 | 500 |
| Example 17 | Overcoat | Sb-doped $SnO_2$ | PSA/PVA | 75 | 500 |
| Example 18 | Overcoat | Sb-doped $SnO_2$ | Gelatin | 75 | 500 |
| Example 19 | Overcoat | Sb-doped $SnO_2$ | Witcobond 232 | 40 | 500 |

TABLE 2

| Element | Surface Resistivity Ω/Square | Tabler Abrasion (% Haze) | Blue $D_{min}$ | Appearance After Processing | Dusting |
|---|---|---|---|---|---|
| Control 1 | $7.0 \times 10^{13}$ | 17.0 | 0.14 | Good | 4 |
| Control 2 | $8.0 \times 10^{13}$* | 8.0 | 0.12 | Good | 1 |
| Example 1 | $7.4 \times 10^{10}$ | ** | 0.15 | Good | 1 |
| Example 2 | $7.4 \times 10^{9}$ | ** | 0.15 | Good | 1 |
| Example 3 | $5.2 \times 10^{9}$ | 12.3 | 0.15 | Good | 3 |
| Example 4 | $9.3 \times 10^{8}$ | 13.2 | 0.14 | Good | 1 |
| Example 5 | $2.9 \times 10^{9}$ | ** | 0.15 | Good | 2 |
| Example 6 | $2.1 \times 10^{8}$ | ** | 0.16 | Good | 3 |
| Example 7 | $5.4 \times 10^{10}$ | ** | ** | Good | 1 |
| Example 8 | $3.1 \times 10^{8}$ | 9.7 | 0.14 | Good | 1 |
| Example 9 | $6.0 \times 10^{7}$ | 9.3 | 0.14 | Good | 1 |
| Example 10 | $5.1 \times 10^{10}$ | ** | ** | Good | 1 |
| Example 11 | $1.8 \times 10^{9}$ | 15.1 | 0.15 | Good | 3 |
| Example 12 | $1.5 \times 10^{8}$ | 15.2 | 0.15 | Good | 2 |
| Example 13 | $2.8 \times 10^{9}$ | ** | ** | Good | 1 |
| Example 14 | $2.1\ 10^{8}$ | 11.5 | 0.14 | Good | 1 |
| Example 15 | $9.3 \times 10^{7}$ | 12.3 | 0.15 | Good | 1 |
| Example 16 | $2.0 \times 10^{8}$ | ** | ** | Good | ** |
| Example 17 | $6.0 \times 10^{10}$ | ** | 0.19 | Good | ** |

TABLE 2-continued

| Element | Surface Resistivity Ω/Square | Tabler Abrasion (% Haze) | Blue $D_{min}$ | Appearance After Processing | Dusting |
|---|---|---|---|---|---|
| Example 18 | $1.0 \times 10^{11}$ | ** | 0.10 | Good | ** |
| Example 19 | $4.9 \times 10^{10}$ | ** | 0.13 | Good | ** |

*Control 2 had an internal resistivity (salt-bridge method) = $5 \times 10^8$ Ω/square
**indicates not measured

TABLE 3

| Element | S | $q_o$ (nanocoulombs/m$^2$) | $q_e$ (nanocoulombs/m$^2$ |
|---|---|---|---|
| Control 1 | 0.971 | −21.7 | −748.3 |
| Control 2 | 0.915 | 5.7 | 67.1 |
| Example 2 | 0.453 | 18.4 | 33.6 |

The results provided in Table 2 show that the electroconductive outermost layers of the present invention provide lower surface resistivity values compared with either of the control elements while providing acceptable characteristics with respect to dusting, abrasion resistance, blue $D_{min}$, and appearance after thermal processing. The results also show that the electroconductive outermost layer is equally effective whether it overlies the imaging layer or is on the side of the support opposite to the imaging layer (i.e., as a backing layer). As indicated by the results in Table 3 above, it is most effective to utilize a thermally processable imaging element which contains the electroconductive layer as the outermost layer since this provides the lowest values of s and equilibrium charge.

The invention has been described in detail, with particular reference to certain preferred embodiments thereof, but it should be understood that variations and modifications can be effected within the spirit and scope of the invention.

We claim:

1. A thermally processable imaging element, said element comprising:

(1) a support;

(2) a thermographic or photothermographic imaging layer on one side of said support; and (3) at least one electroconductive outermost layer comprised of electrically-conductive metal-containing particles dispersed in a polymeric binder in an amount sufficient to provide a surface resistivity of less than $5\times10^{11}$ ohms/square; said electroconductive outermost layer exhibiting a percent haze as measured by Taber abrasion testing of not more than 15.2 percent.

2. A thermally processable imaging element, said element comprising:

(1) a support;

(2) a thermographic or photothermographic imaging layer on one side of said support;

(3) an electroconductive overcoat layer which is an outermost layer on the same side of said support as said imaging layer, said electroconductive overcoat layer being comprised of electrically-conductive metal-containing particles dispersed in a polymeric binder in an amount sufficient to provide a surface resistivity of less than $5\times10^{11}$ ohms/square; said electroconductive overcoat layer exhibiting a percent haze as measured by Taber abrasion testing of not more than 15.2 percent; and (4) a non-electroconductive backing layer which is an outermost layer located on the side of said support opposite to said imaging layer, said backing layer comprising a binder and a matting agent dispersed therein.

3. A thermally processable imaging element, said element comprising:

(1) a support;

(2) a thermographic or photothermographic imaging layer on one side of said support;

(3) a non-electroconductive overcoat layer which is an outermost layer on the same side of said support as said imaging layer; and (4) an electroconductive backing layer which is an outermost layer located on the side of said support opposite to said imaging layer;

said electroconductive backing layer comprising a polymeric binder, a matting agent and electrically-conductive metal-containing particles dispersed in said binder in an amount sufficient to provide a surface resistivity of less than $5\times10^{11}$ ohms/square; said electroconductive backing layer exhibiting a percent haze as measured by Taber abrasion testing of not more than 15.2 percent.

4. A thermally processable imaging element, said element comprising:

(1) a support;

(2) a thermographic or photothermographic imaging layer on one side of said support;

(3) an electroconductive overcoat layer which is an outermost layer on the same side of said support as said imaging layer, said electroconductive overcoat layer being comprised of electrically-conductive metal-containing particles dispersed in a polymeric binder in an amount sufficient to provide a surface resistivity of less than $5\times10^{11}$ ohms/square; and (4) an electroconductive backing layer which is an outermost layer located on the side of said support opposite to said imaging layer; said electroconductive backing layer comprising a polymeric binder, a matting agent and electrically-conductive metal-containing particles dispersed in said binder in an amount sufficient to provide a surface resistivity of less than $5\times10^{11}$ ohms/square; each of said electroconductive overcoat layer and electroconductive backing layer exhibiting a percent haze as measured by Taber abrasion testing of not more than 15.2 percent.

5. A thermally processable imaging element as claimed in claim 1 wherein said surface resistivity is less than $1\times10^{11}$ ohms/square.

6. A thermally processable imaging element as claimed in claim 1, wherein said support is a poly(ethylene terephthalate) film.

7. A thermally processable imaging element as claimed in claim 1, wherein said imaging layer comprises:

(a) photographic silver halide, (b) an image-forming combination comprising (i) an organic silver salt oxidizing agent, with (ii) a reducing agent for the organic silver salt oxidizing agent, and (c) a toning agent.

8. A thermally processable imaging element as claimed in claim 1, wherein said imaging layer comprises:

(a) photographic silver halide, (b) an image-forming combination comprising (i) silver behenate, with (ii) a phenolic reducing agent for the silver behenate, (c) a succinimide toning agent, and (d) an image stabilizer.

9. A thermally processable imaging element as claimed in claim 1, wherein said polymeric binder is a polyurethane.

10. A thermally processable imaging element as claimed in claim 1, wherein said polymeric binder is an acrylamide-co-methylmethacrylate-co-hydroxyethyl methacrylate terpolymer.

11. A thermally processable imaging element as claimed in claim 1, wherein said polymeric binder is a polyester ionomer.

12. A thermally processable imaging element as claimed in claim 1, wherein said polymeric binder is a vinylidene chloride-co-methyl acrylate-co-itaconic acid terpolymer.

13. A thermally processable imaging element as claimed in claim 1, wherein said polymeric binder is a combination of poly(silicic acid) and poly(vinyl alcohol).

14. A thermally processable imaging element as claimed in claim 1, wherein said polymeric binder is gelatin.

15. A thermally processable imaging element as claimed in claim 1, wherein said electroconductive layer comprises a colloidal gel of vanadium pentoxide.

16. A thermally processable imaging element as claimed in claim 1, wherein said electroconductive-layer comprises antimony-doped tin oxide particles.

17. A thermally processable imaging element as claimed in claim 1, wherein said electroconductive layer comprises a colloidal gel of vanadium pentoxide in an amount of about 1 to 30 $mg/m^2$.

18. A thermally processable imaging element as claimed in claim 1, wherein said electroconductive layer comprises antimony-doped tin oxide particles in an amount of less than about 1 $gm/m^2$.

* * * * *